US008615917B2

(12) United States Patent
Higgins

(10) Patent No.: US 8,615,917 B2
(45) Date of Patent: Dec. 31, 2013

(54) PROTECTIVE COVER FOR FIREARM LOWER RECEIVER

(76) Inventor: Eric Higgins, San Francisco, CA (US)

( * ) Notice: Subject to any disclaimer, the term of this patent is extended or adjusted under 35 U.S.C. 154(b) by 50 days.

(21) Appl. No.: 13/403,016

(22) Filed: Feb. 23, 2012

(65) Prior Publication Data

US 2013/0160343 A1 Jun. 27, 2013

Related U.S. Application Data

(60) Provisional application No. 61/580,030, filed on Dec. 23, 2011.

(51) Int. Cl.
*F41A 35/02* (2006.01)

(52) U.S. Cl.
USPC ..... 42/96; 206/317

(58) Field of Classification Search
USPC ..... 42/90, 96, 106; 206/317
See application file for complete search history.

(56) References Cited

U.S. PATENT DOCUMENTS

| | | | | |
|---|---|---|---|---|
| 5,806,228 | A * | 9/1998 | Martel et al. | 42/124 |
| 6,761,101 | B1 * | 7/2004 | Luth | 89/37.04 |
| 8,209,896 | B1 * | 7/2012 | Cashwell | 42/94 |
| 2009/0241398 | A1 * | 10/2009 | Luth | 42/96 |
| 2012/0042554 | A1 * | 2/2012 | Rich | 42/16 |

* cited by examiner

*Primary Examiner* — Gabriel Klein
(74) *Attorney, Agent, or Firm* — Plager Schack, LLP

(57) ABSTRACT

A protective cover for a firearm lower receiver attaches directly and securely to the lower receiver, protecting it from any impact or debris, yet it may still be used with existing firearm protective cases and bags. Forward and rearward assembly pin holes allow securing of the protective cover to the lower receiver with assembly pins. An extrusion on a lower surface of the protective cover is capable of depressing a magazine door of a magazine installed in the lower receiver and may be transparent to allow a user to view contents of the magazine while keeping the contents protected from debris.

10 Claims, 2 Drawing Sheets

PROTECTIVE COVER FOR FIREARM LOWER RECEIVER

CROSS REFERENCE TO RELATED APPLICATIONS

This application claims the priority benefit of U.S. Provisional Application No. 61/580,030, filed on Dec. 23, 2011 which is incorporated herein by reference in its entirety.

BACKGROUND OF THE INVENTION

The AR-15/M16 firearms are designed with two takedown assembly pins which join the upper receiver to the lower receiver. The lower receiver houses the trigger mechanism, hammer, bolt catch & release mechanism, safety mechanism, magazine release mechanism, magazine well, and recoil buffer assembly. All of these components are critical for the safe and reliable operation of the firearm.

When the takedown assembly pins are disengaged, the upper and receiver can be separated for storage, transport, inspection, or cleaning. While the upper and lower receivers are separated, the components and internal cavities within the lower receiver are exposed and subject to damage debris. Unprohibited movement of the hammer is also possible in this separated state and can lead to hammer over-travel. This hammer over-travel can damage the lower receiver housing, bolt catch & release mechanism and hammer.

Firearm protective cases and bags do not provide adequate protection of the lower receiver inner components because the components are still exposed to impact. Furthermore, any debris already inside the bag or case may become lodged within the lower receiver. Firearm protective cases and bags encase the entire firearm or the entire lower receiver of the firearm, not just the inner components. Firearm protective cases and bags do not attach directly to the lower receiver and fully cover the exposed parts.

SUMMARY OF THE INVENTION

A lower receiver cover is a device which joins to the lower receiver using the takedown assembly pins and covers and protects the components housed in the lower receiver.

The lower receiver cover of the present invention attaches directly and securely to the lower receiver of a firearm, protecting it from any impact or debris and may be used with existing firearm protective cases and bags.

The lower receiver cover has a sufficient internal depth to prohibit movement of the hammer in case the safety is disabled and the trigger is pulled. Prohibiting movement of the hammer in this way also prevents damage due to over-travel.

The lower receiver cover further includes an extrusion to mate over the top of a magazine well to compress a loaded or unloaded magazine that is fully inserted and engaged in the magazine well. This extrusion can remove pressure from the magazine feed lips, preventing additional wear and increasing magazine life and reliability. The extrusion may also be made of a transparent material, such as acrylic, to act as a window that allows an inserted and engaged magazine to be determined if it is loaded with ammunition.

DETAILED DESCRIPTION OF THE INVENTION

Figure 1:
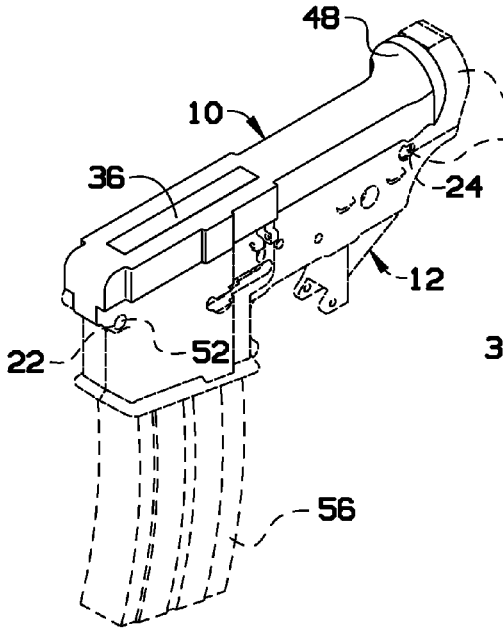
FIG. 1 illustrates a perspective view of the invention 10 shown use.

As illustrated by FIGS. 1-8 the firearm lower receiver protective cover 10 is a device designed to attach to the lower receiver 12 of an AR-15/M16 style firearm for the purpose of protecting the mating surface 14 and internal components of the lower receiver 12. Upper receiver (not shown) is separated from lower receiver 12 by removal of front 52 and rear 53 assembly pins from holes 22 and 24.

Figure 2:
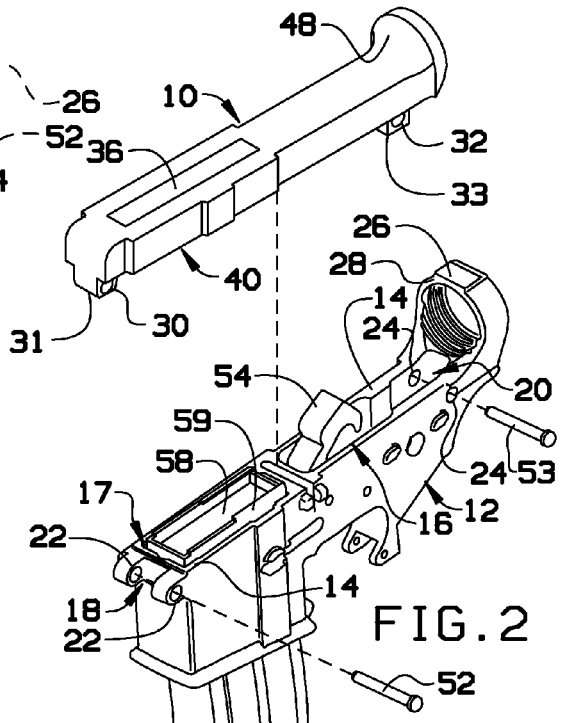
FIG. 2 illustrates an exploded view of the invention 10.
Figure 3:
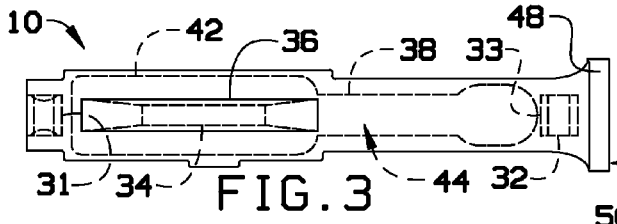
FIG. 3 illustrates a top view of the invention 10.
Figure 4:
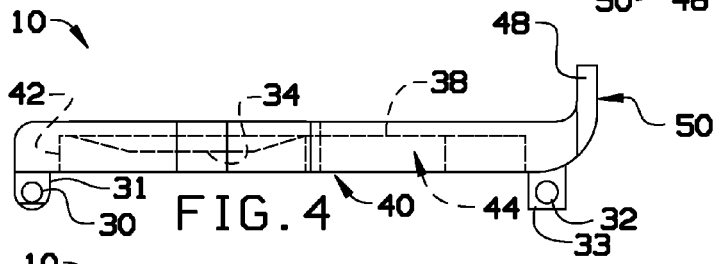
FIG. 4 illustrates a side view of the invention 10.
Figure 5:
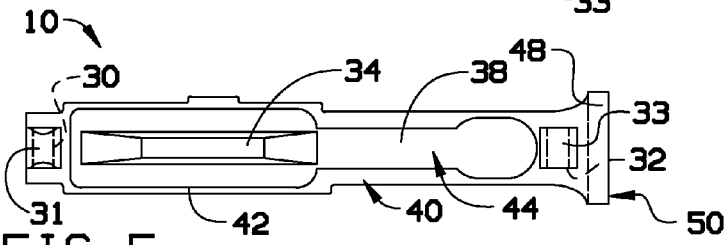
FIG. 5 illustrates a bottom view of the invention 10.
Figure 6:
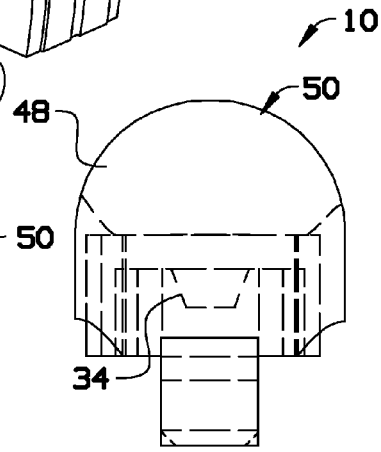
FIG. 6 illustrates a rear view of the invention 10.
Figure 7:
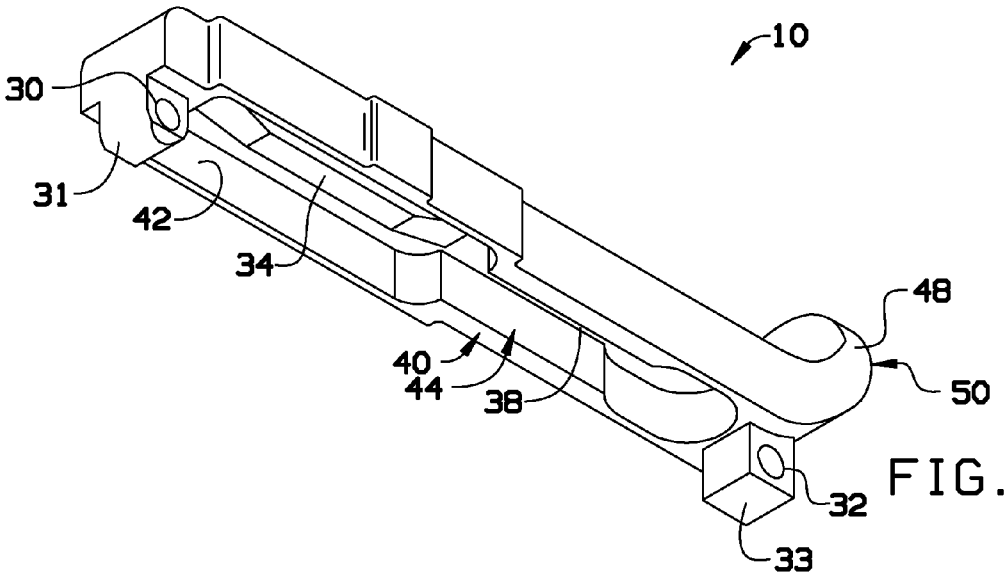
FIG. 7 illustrates a forward perspective view of the invention 10.
Figure 8:
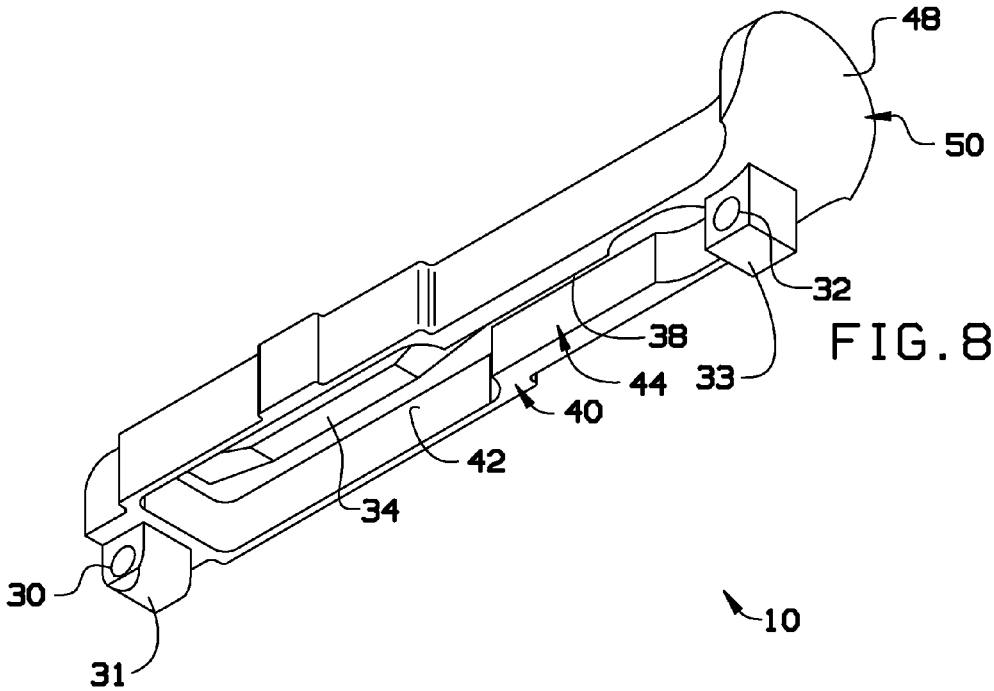
FIG. 8 illustrates a rearward perspective view of the invention 10.

After removal of the upper receiver, firearm lower receiver protective cover 10 is assembled to the lower receiver 12 by placing the lower mating surface 40 of the firearm lower receiver protective cover 10 against upper mating surface 14 of lower receiver 12 with hammer 54 of lower receiver 12 locked back to the rearward position. Trigger assembly channel 44 should be positioned over cavity 16 such that hammer arrester surface 38 may compress and retain the hammer 54 when lower receiver protective cover 10 is mated to lower receiver 12. Firearm lower receiver protective cover 10 is secured to lower receiver 12 by re-inserting front 52 and rear 53 assembly pins through front 22 and rear 24 assembly pin holes and further through front 30 and rear 32 assembly pin holes formed in front 31 and rear 33 engagement members of firearm lower receiver protective cover 10 as shown in FIG. 2.

Lower mating surface 40 of firearm lower receiver protective cover 10 preferably matches upper mating surface 14 such that the edge of surface of lower receiver 12 is fully covered such that no gaps or spaces exist. Thus, foreign material or objects, such as dirt and debris, may be prevented from entering cavity 16 of firearm lower receiver 12 while firearm lower receiver protective cover 10 is properly installed.

Magazine channel 42 should align with the magazine well 17 of the lower receiver allowing magazine spring compression extrusion 34 to push the spring-loaded magazine door 58 of any magazine 56 installed in lower receiver 12. In this way, pressure of spring-loaded magazine door 58 on magazine feed lips 59 is reduced if not eliminated.

The hammer 54 of the lower receiver 12 may be retained in the "cocked" position to the rear of the lower receiver 12 and prohibited from release, regardless of trigger pull or position, by the pressure applied from the hammer arrester surface 38 of trigger assembly channel 44 of firearm lower receiver protective cover 10.

At its rear end, the lower receiver protective cover 10 is provided with a stock bracket buttress mating surface 58 which has a circular edge. Buttress mating surface 58 is designed to cover and protect the edge of stock bracket buttress 4 of the lower receiver 12.

The firearm lower receiver protective cover 10 should preferably be constructed of a material which will not damage mating surface 14 of firearm lower receiver 12 through friction, abrasion, or impact, yet is strong enough to withstand sufficient external impact, abrasion and other forces that might otherwise be damaging to lower receiver 12. In this way the internal components of the firearm lower receiver 12 and lower receiver mating surface 14 may be protected. Representative materials include, but are not limited to, wood, plastic, polymer, or metal as well as any combination of these materials.

The magazine spring compression extrusion 34 may be made of a transparent or translucent material and extend to the top of the firearm lower receiver protective cover 10 so as to create the ammunition window 36. The ammunition window 36 allows the contents of installed ammunition magazines 56 to be inspected for any ammunition they might contain.

Ideally, the protective invention should be made from one or two pieces of material that are molded or machined to the correct sizes and specifications, then connected using a high-strength glue or epoxy, or some other fastener which does not negatively affect the performance of the invention. In embodiments in which the ammunition window 36 is made from a separate transparent material, it may be secured in place with glue or epoxy.

In some embodiments, the front 30 and rear 32 assembly pin holes could be the assembly pins rather than requiring the pins to be removed and inserted. In such cases, these pins could compress and extend to engage assembly pin holes of a lower receiver 12.

The above-described embodiments of the invention are presented for purposes of illustration And not of limitation. Let it be understood that the steps disclosed may be performed in a different order and remain within the scope of the present invention.

I claim:

1. A cover for a firearm lower receiver, said cover comprising:

an elongated member with front and rear ends, two side surfaces and upper and lower surfaces;

on said lower surface near said front and rear ends, two engagement members project away from said lower surface and are configured to align with assembly pin holes of the firearm lower receiver to facilitate securement of the cover to the firearm lower receiver;

a cavity formed in said lower surface between said two engagement members, said cavity also having an elongated shape and including a cavity upper surface parallel with the upper and lower surfaces of said elongated member;

wherein said cavity has an extrusion portion near the front end and a channel portion near said rear end;

wherein a width of said cavity between said two side surfaces is greater within the extrusion portion and lesser in the channel portion;

a first extrusion in said extrusion portion of said cavity projecting from said cavity upper surface toward the lower surface of said elongated member and configured to engage an ammunition magazine installed in said firearm lower receiver;

a circular extension at said rear end protruding upward from said upper surface and having a distal surface configured to engage a lower receiver stock bracket buttress of a firearm to protect internal edges of said stock bracket buttress.

2. The cover of claim 1, further comprising:

pin holes formed through said two engagement members in a direction from one of said two side surfaces to the other of said two side surfaces, said pin holes capable of receiving firearm lower receiver assembly pins to secure said cover to a lower receiver of a firearm with said lower surface contacting upper surfaces of said lower receiver to protect the same and prevent debris from entering a trigger mechanism cavity of said lower receiver.

3. The cover of claim 1, wherein said first extrusion has the general shape of a truncated rectangular pyramid.

4. The cover of claim 1, wherein a hammer of a lower receiver may be received by said channel portion and be restricted from movement in a forward direction by engagement with said cavity upper surface.

5. The cover of claim 1, wherein when said cover is engaged with a lower receiver of a firearm, said first extrusion is capable of engaging a magazine door of an ammunition magazine installed in said lower receiver in order to depress the magazine door to prevent the magazine door from pressuring magazine feed lips of said magazine.

6. The cover of claim 5, wherein said first extrusion is formed of a transparent material extending from the upper surface of the elongated member and into said cavity such that a user may see entirely through the cover due to said transparency and view any ammunition held by the magazine.

7. The cover of claim 1, wherein said channel portion of said cavity expands into a circular or ovular shape near the rear end.

8. The cover of claim 1, wherein the circular extension has a circular edge in a plane generally perpendicular to each of said upper, lower and two side surfaces.

9. A cover for a firearm lower receiver, said cover comprising:

an elongated member with front and rear ends, two side surfaces and upper and lower surfaces;

on said lower surface near said front and rear ends, two engagement members project away from said lower surface;

said engagement members including pin holes formed through said two engagement members in a direction from one of said two side surfaces to the other of said two side surfaces, said pin holes capable of receiving firearm lower receiver assembly pins to secure said cover to a lower receiver of a firearm with said lower surface contacting upper surfaces of said lower receiver to protect the same and prevent debris from entering a trigger mechanism cavity of said lower receiver;

a cavity formed in said lower surface between said two engagement members, said cavity also having an elongated shape and including a cavity upper surface parallel with the upper and lower surfaces of said elongated member;

wherein said cavity has an extrusion portion near the front end and a channel portion near said rear end and wherein said channel portion of said cavity expands into a circular or ovular shape near the rear end;

wherein a hammer of a lower receiver may be received by said channel portion and be restricted from movement in a forward direction by engagement with said cavity upper surface;

wherein a width of said cavity between said two side surfaces is greater within the extrusion portion and lesser in the channel portion;

an extrusion in said extrusion portion of said cavity projecting from said cavity upper surface toward the lower surface of said elongated member;

wherein when said cover is engaged with a lower receiver of a firearm, said extrusion is capable of engaging a magazine door of an ammunition magazine installed in said lower receiver in order to depress the magazine door to prevent the magazine door from pressuring magazine feed lips of said magazine;

a circular extension at said rear end protruding upward from said upper surface and having a distal surface capable of engaging a lower receiver stock bracket buttress of a firearm to protect internal edges of said stock bracket buttress;

wherein said circular extension has a circular edge in a plane generally perpendicular to each of said upper, lower and two side surfaces.

10. The cover of claim 9, wherein said extrusion is formed of a transparent material extending from the upper surface of the elongated member and into said cavity such that a user may see entirely through the cover due to said transparency and view any ammunition held by the magazine.

* * * * *